US006485312B1

(12) United States Patent
Yu

(10) Patent No.: US 6,485,312 B1
(45) Date of Patent: Nov. 26, 2002

(54) ELECTRICAL CONNECTOR ASSEMBLY

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/997,526

(22) Filed: Nov. 29, 2001

(51) Int. Cl.[7] ..... H01R 12/00
(52) U.S. Cl. ..... 439/74
(58) Field of Search ..... 439/74, 660

(56) References Cited

U.S. PATENT DOCUMENTS 5,199,884 A * 4/1993 Kaufman et al. ..... 439/566
5,478,248 A * 12/1995 Mitra et al. ..... 439/74
5,626,500 A * 5/1997 Yoshimura ..... 439/637
5,915,976 A * 6/1999 McHugh ..... 439/108
6,159,021 A * 12/2000 Kusuhara ..... 439/74

* cited by examiner

*Primary Examiner*—Tulsidas Patel
(74) *Attorney, Agent, or Firm*—Wei Te Chung

(57) ABSTRACT

An electrical connector assembly (1) comprises a male connector (10) and a female connector (30). The male connector has an elongate first insulative housing (12) and a plurality of male contacts (20) and the female connector has an elongate second insulative housing (31) and a plurality of female contacts (40). Each male contact has a mating portion (22) that can simultaneously contact a first and a second mating portions (44), (42) of the female contact such that a steady and liable electrical connection therebetween is established.

7 Claims, 6 Drawing Sheets

ELECTRICAL CONNECTOR ASSEMBLY

BACKGROUND OF THE INVENTION

1. Field of the Invention

The present invention relates to the art of electrical connectors, more particularly to electrical contacts of electrical connector assemblies for improving the performance of electrical connection therebetween.

2. Description of the Related Art

A connector assembly generally includes a male and a female connector mounted respectively on two spaced PC boards and adapted to mate with each other for mechanical and electrical interconnection therebetween. Each male and female connector commonly includes a miniature and elongate insulative housing that is manufactured by injection molding. The housing of the male connector is apt to deform in a lateral direction as a result of the remnant stress acting thereon. However, the level of deformation at both ends of the housing is different with the level of deformation at a middle portion of the housing. Therefore, side walls of the housing are inclined not to be planar. In such case, electrical contacts defined in the housing correspondingly offset from its correct positions such that the normal force between certain male contacts of the male connector and the female contacts of the female connector may become insufficient when the male connector and the female connector are mated. As a result, a reliable electrical connection between the male connector and the female connector cannot be assured.

Therefore, an object of the invention is to provide an electrical connector assembly wherein male contacts of a male connector can establish a stable contact with corresponding female contacts of a female connector for preventing an unstable electrical connection therebetween.

SUMMARY OF THE INVENTION

According to an aspect of the invention, an electrical connector assembly in accordance with the present invention comprises a male connector and a female connector. The male connector has an elongate first insulative housing and a plurality of male contacts defined therein. Each male contact has a mating portion retained in the first housing and a tail portion bent vertically from the mating portion and extending out from the first housing. Each female connector has an elongate second insulative housing and a plurality of female contacts defined therein. Each female contact has a base portion extending outside of the second housing, and a first and second mating portions bent vertically and extending upwardly from the base portion, respectively. The first and second mating portions are approximately parallel with each other and define a space therebetween for receiving the mating portion of the male contact therein. Thus, the mating portion of the male contact contacts with both the first and the second mating portions of the female contact such that a stable and liable electrical connection therebetween is established.

Other objects, advantages and novel features of the present invention will be drawn from the following detailed description of a preferred embodiment of the present invention with attached drawings, in which:

DESCRIPTION OF THE PREFERRED EMBODIMENT

Figure 1:
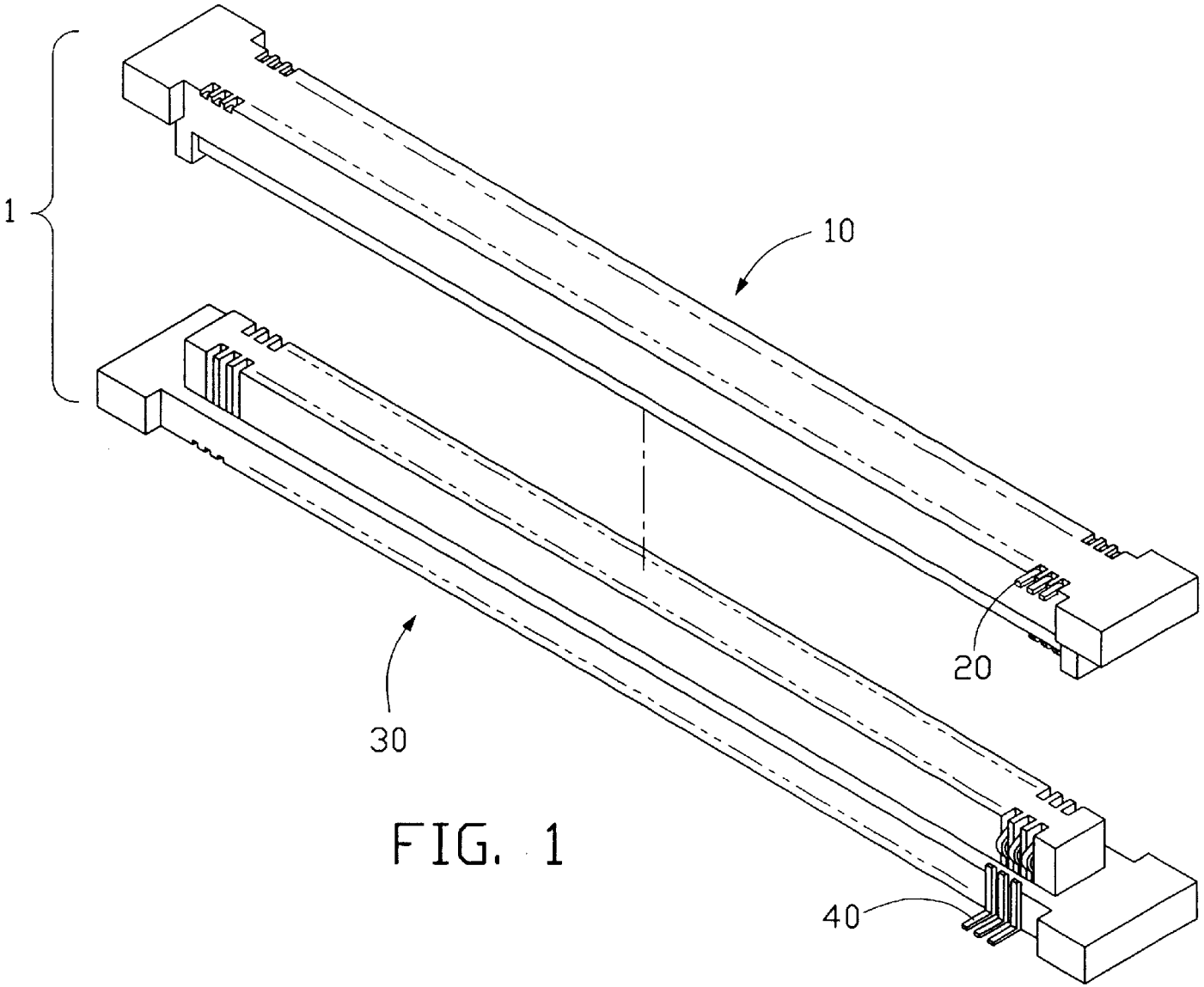
FIG. 1 is an exploded view of an electrical connector assembly in accordance with a preferred embodiment of the present invention.

Referring to FIG. 1, an electrical connector assembly 1 in accordance with a preferred embodiment of the present invention includes a male connector 10 and a female connector 30 mating with the male connector 10.

Figure 2:
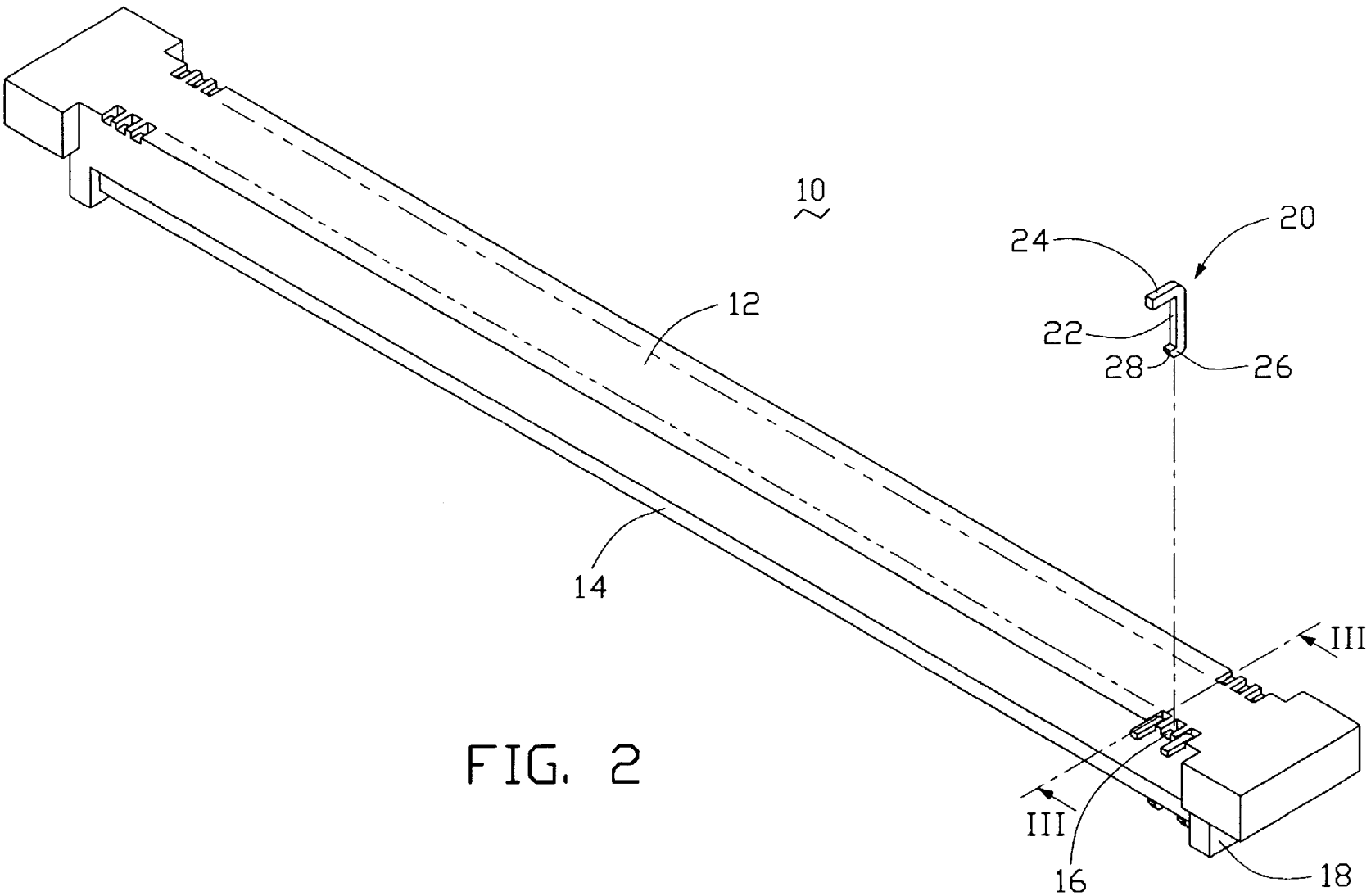
FIG. 2 is an exploded view of a male connector of the electrical connector assembly of FIG. 1.
Figure 3:
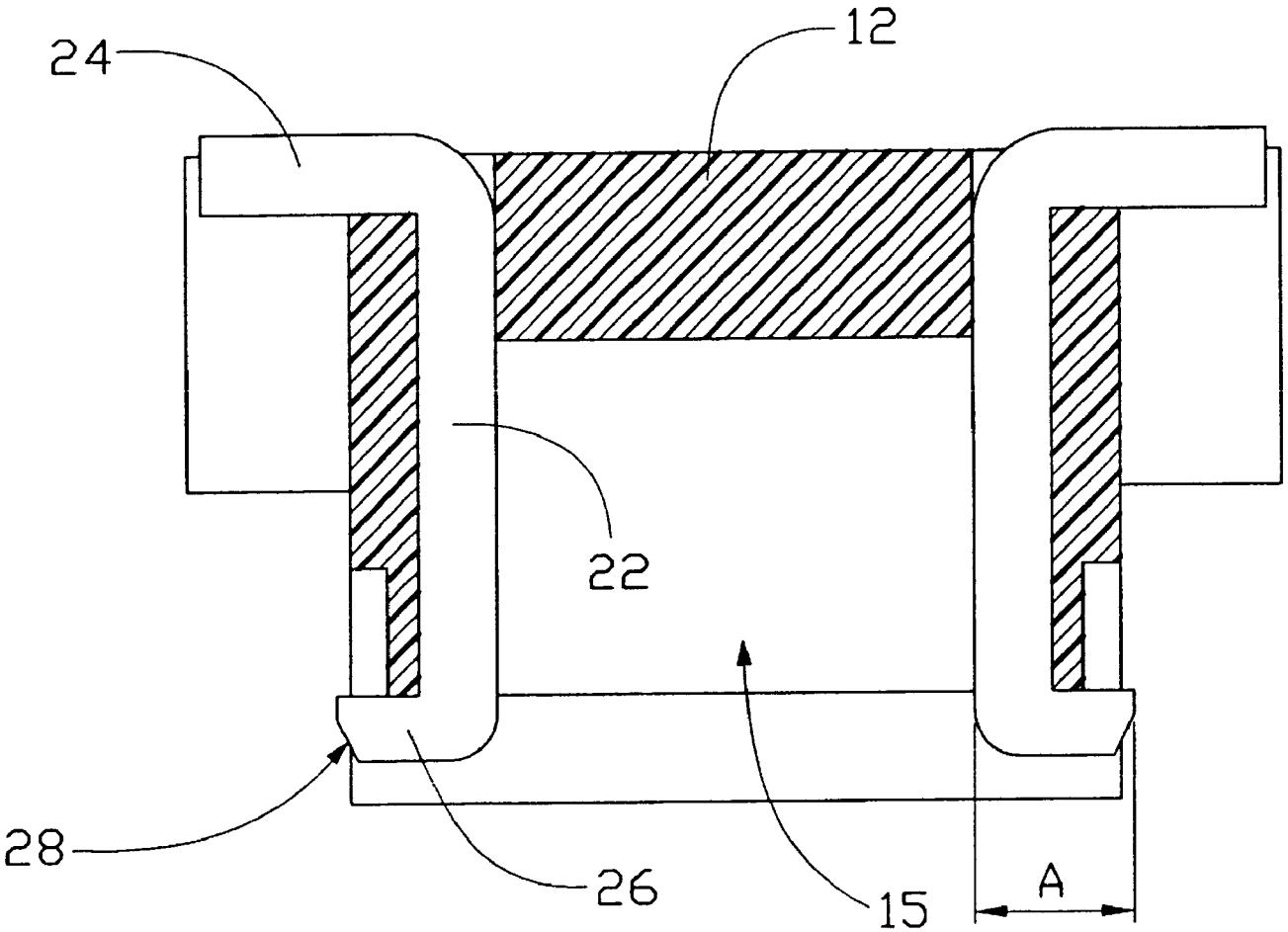
FIG. 3 is a cross-sectional view taken along line III—III in FIG. 2.

Referring particularly to FIGS. 2 and 3, the male connector 10 includes an elongate first insulative housing 12 and a plurality of male contacts 20 defined therein. The first housing 12 has a pair of side walls 14, a pair of end walls 18, and a central recess 15 surrounded by the side walls 14 and end walls 18. A plurality of first receiving slots 16 is defined in the bottom wall of the housing 12 and extends through the bottom wall. Each male contact 20 comprises a mating portion 22 received in the first receiving slot 16 and a tail portion 24 extending vertically out of the bottom wall of the housing 12. The mating portion 22 has a mating end 26 bent vertically and outwardly at one end thereof for attaching on a top surface of the side wall 14. The mating end 26 has a first sloping contacting surface 28 and has a given width "A" for purposes described hereinafter.

Figure 4:
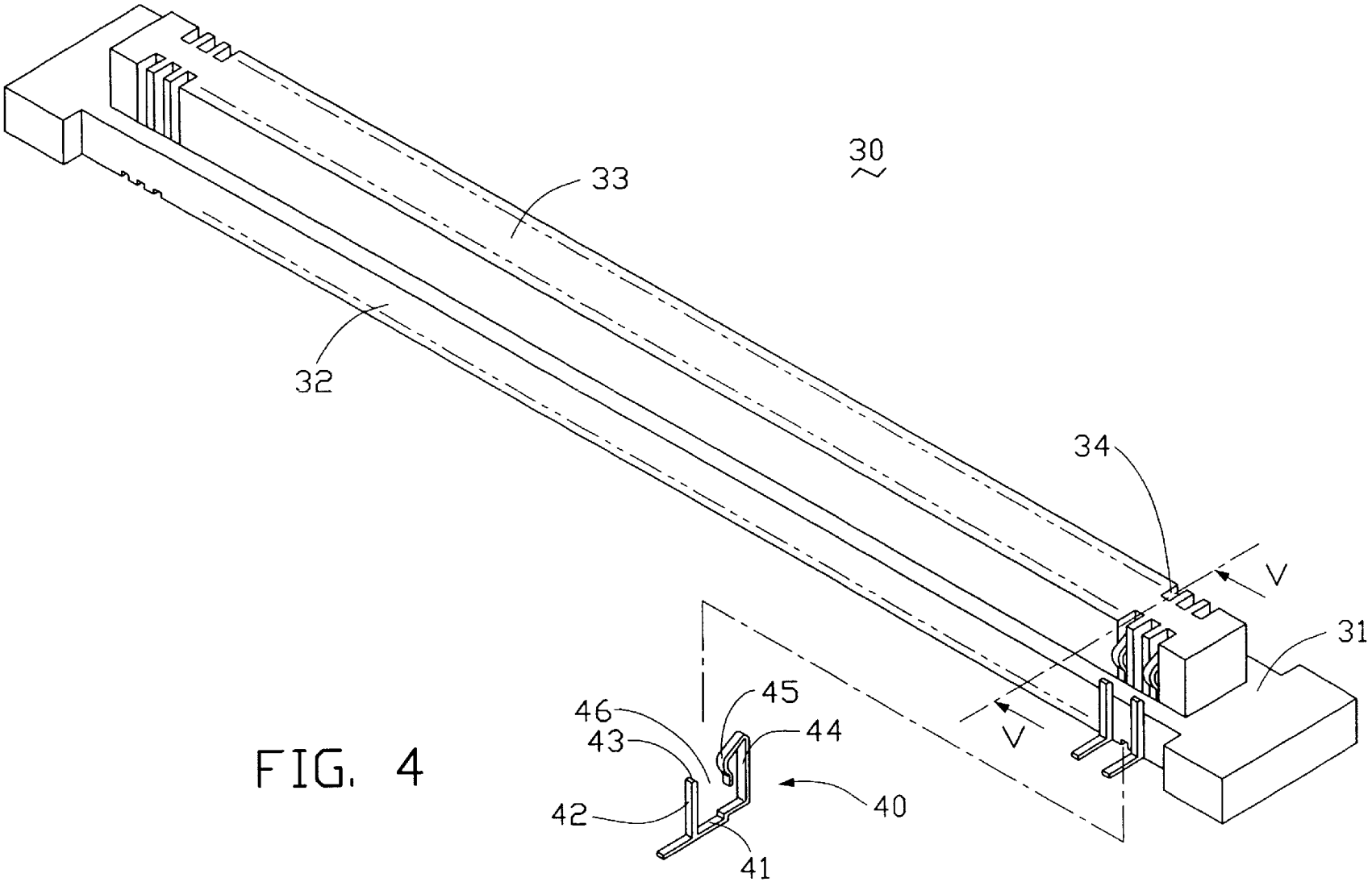
FIG. 4 is an exploded view of a female connector of the electrical connector assembly of FIG. 1.
Figure 5:
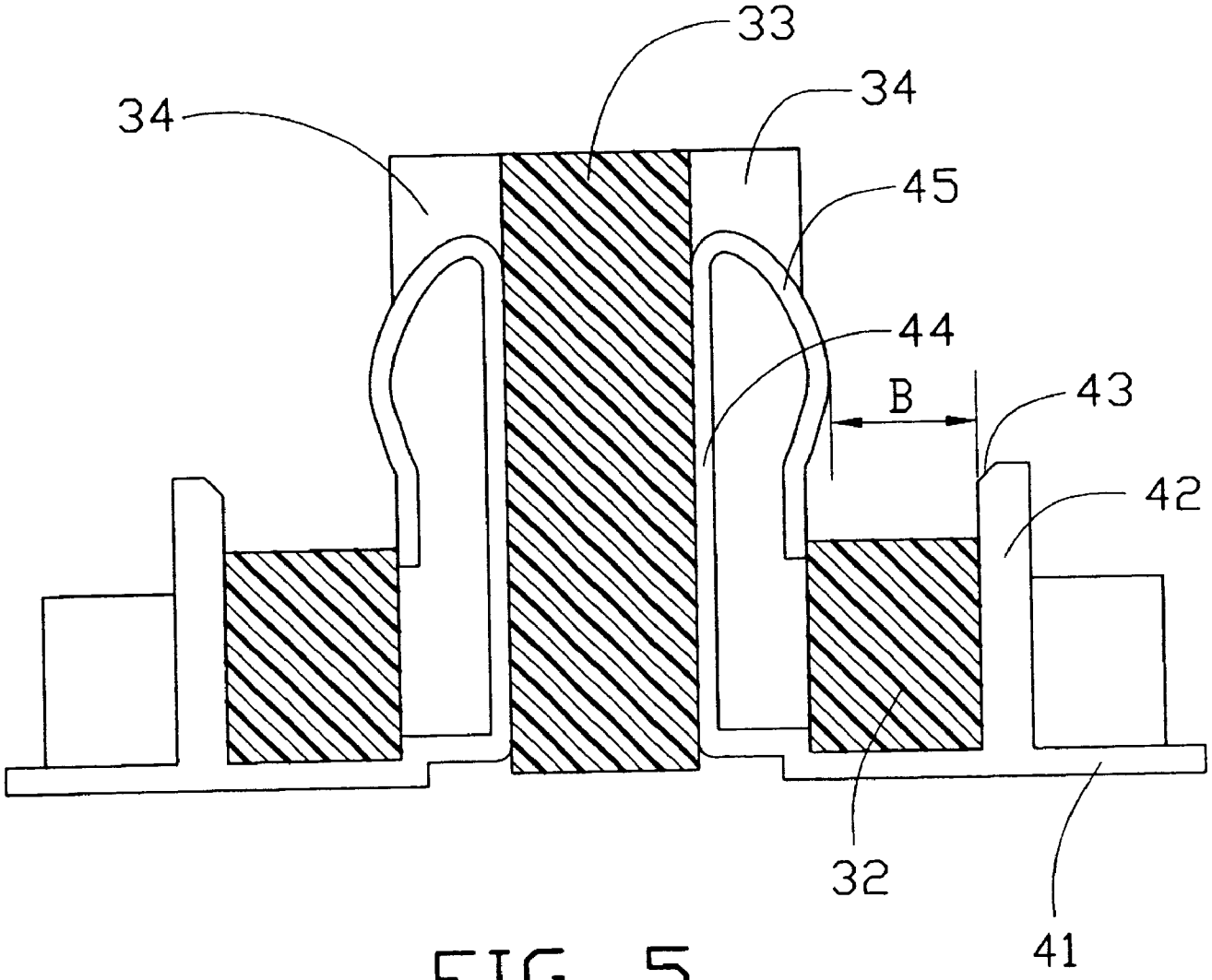
FIG. 5 is a cross-sectional view taken along line V—V in FIG. 4.

Referring particularly to FIGS. 4 and 5, the female connector 30 includes an elongate second insulative housing 31 and a plurality of female contacts 40 defined therein. The housing 31 has two spaced side walls 32 and a central island 33 defined between the side walls 32. The central island 33 defines a plurality of second receiving passageways 34 in opposite longitudinal sides thereof for receiving the female contacts 40. Each female contact 40 has a base portion 41 defined horizontally under the bottom wall of the housing 31. A first contacting portion 44 extends upwardly from one inner end of the base portion 41 in a vertical direction, the first contacting portion 44 is received in the second receiving slot 34 with a bending end 45 partly extending out of the second receiving passageway 34. A second contacting portion 42 extends upwardly near an outer end of the base portion 41 in a direction substantially parallel with the first contacting portion 44. The second contacting portion 42 is located immediately outside the side wall 32 and extends beyond a top surface of the side wall 32. The second contacting portion 42 further defines a second sloping contacting surface 43 at a tip thereof for easily mating with the first sloping contacting surface 28 of the mating end 26 of the male contact 20. Referring to FIG. 5, the space 46 between the tip of the bending end 45 and an inner side of the second contacting portion 42 has a given width "B" that is slightly narrower than the width "A" of the mating end 26 of the male contact 20.

Figure 6:
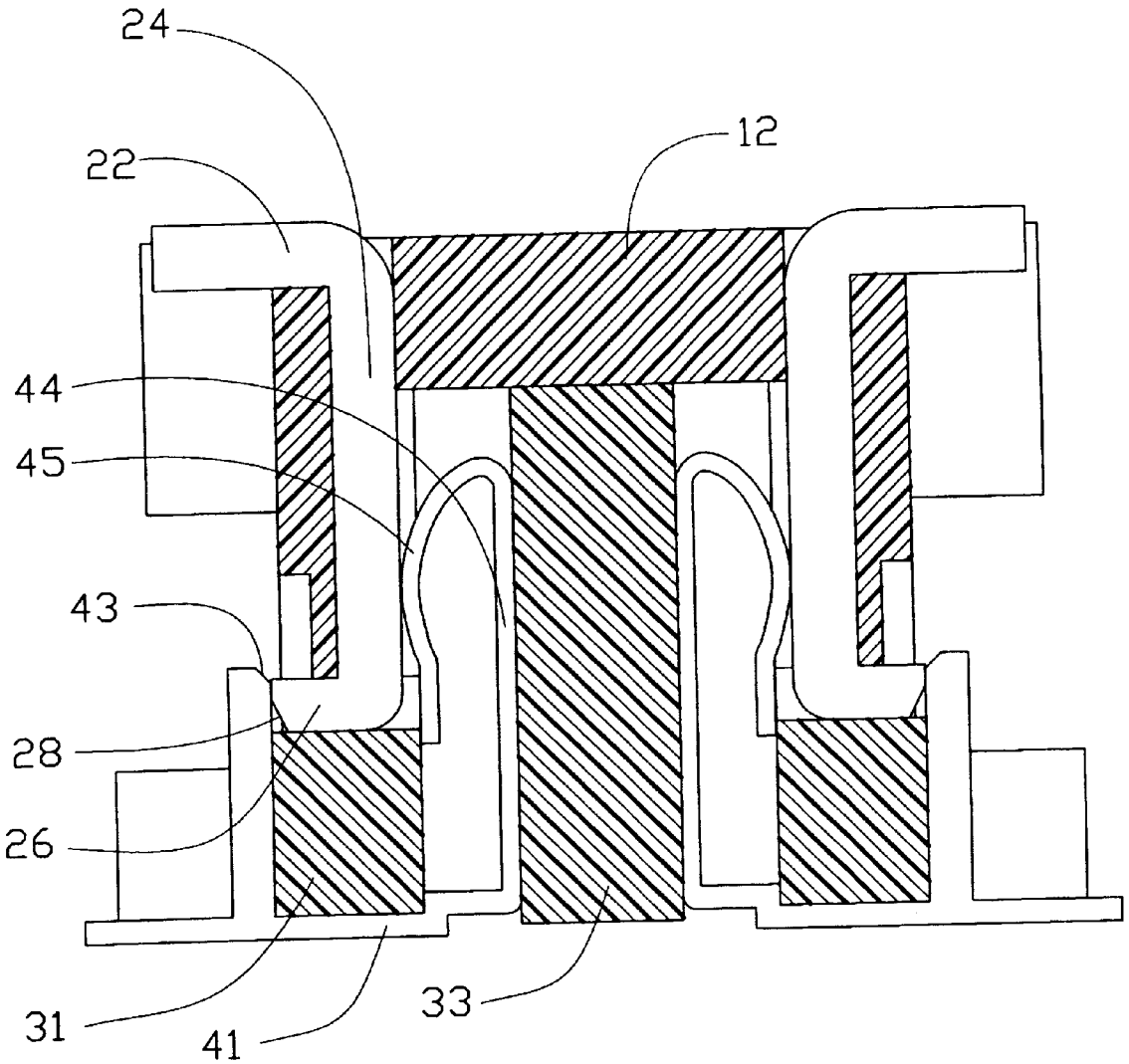
FIG. 6 is a cross-section al view showing electrical connection of a male contact and a female contact when the male connector and the female connector are mated.

Referring to FIG. 6, in assembling, the central recess 14 of the first housing 12 of the male connector 10 receives the central island 33 of the second housing 31 of the female connector 30. Simultaneously, each male contact 20 mates with corresponding female contact 40 with the mating end 26 of the male contact 20 inserted into the space 46 and respectively establishing electrical connection with the first and second contacting portions 44, 42 of the female contacting 40. With that understood, if a protruding deformation along the first housing 12 of the male connector 10 occurs, the mating end 26 of the male contact 20 firstly contacts the second contacting portion 42 of the female contact 40 with the second sloping surface 43 leading the male contact 20 along the first sloping surface 28 into the space 46. At the same time, the bending end 45 deforms outwardly such that the space B gets larger under the normal force initiated from the mating end 26 so as to receive the mating end 26 therein. On the other hand, if the first housing 12 of the male connector 10 presents a concave deformation, the mating end 26 of the male contact 20 firstly contacts and oppresses the bending end 45 of the first contacting portion 44 of the female contact 40 such that the bending end 45 deforms outwardly to broaden the space "B". Thus, the mating end 26 can also insert into the space "B" and establish electrical connection with the first and second contacting portion 44, 42, simultaneously.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a male connector comprising an elongate first insualtive housing and a plurality of male contacts defined therein, each male contact having a mating portion;

a female connector comprising an elongate second insulative housing and a plurality of female contacts defined therein, each female contact having a base portion, a first and a second contacting portions spaced from each other and extending upwardly from the base portion in a substantially parallel manner such that a given space is defined therebetween; and the mating portion of the male contact being inserted into the space and establish electrical connection with both the first and the second contacting portions of the female contact; wherein a vertically bending end is formed in one end of the mating portion of the male contact.

2. The electrical connector assembly as claimed in claim 1, wherein a width of the bending end is slightly larger than a width of the space.

3. The electrical connector assembly as claimed in claim 1, wherein the second insulative housing of the female connector has a pair of spaced side walls and a central island defined between the side walls.

4. The electrical connector assembly as claimed in claim 3, wherein the first contacting portion is received in the central island, and the second contacting portion is located outside the side wall and extends beyond the tip surface of the side wall.

5. An electrical connector assembly comprising:

a first connector defining a first housing with a pair of first sidewalls thereof;

a plurality of first contacts disposed on inner faces of said pair of first sidewalls;

a second connector defining a second housing with a pair of second sidewalls with a central island between;

a plurality of second contacts disposed by two sides of said central island; each of said first contacts including a mating portion being inside of the corresponding sidewall, and a mating end being outside of the corresponding first sidewall; and each of said second contacts including a first contacting portion being inside of the corresponding second sidewall, and a second contacting portion being outside of the second corresponding sidewall; wherein for each mated first contact and second contact, the mating portion engages the corresponding first contacting portion and the mating end engages the corresponding second contacting portion.

6. An electrical connector assembly comprising:

a first connector defining a first housing with at least one first sidewall thereof;

a plurality of first contacts with respectively stiff mating portions disposed on an inner face of said first sidewall and stiff mating ends exposed outside of the said first sidewall;

a second connector defining a second housing with at least a second sidewall;

a plurality of second contacts with inner resilient contacting portions and outer stiff contacting portions respectively disposed by two sides of said second sidewall; and the mating portions with the associated first sidewall being sandwiched between the corresponding inner resilient contact portions and outer stiff contacting portions, respectively; wherein the mating portions are mechanically and electrically engaged respectively with the corresponding inner resilient contacting portions, and the mating ends are mechanically and electrically engaged respectively with the corresponding outer stiff contacting portions.

7. An electrical connector assembly, comprising:

a male connector comprising an elongate first insualtive housing and a plurality of male contacts defined therein, each male contact having a mating portion;

a female connector comprising an elongate second insulative housing and a plurality of female contacts defined therein, each female contact having a base portion, a first and a second contacting portions spaced from each other and extending upwardly from the base portion in a substantially parallel manner such that a given space is defined therebetween; and the mating portion of the male contact being inserted into the space and establish electrical connection with both the first and the second contacting portions of the female contact; wherein the second insulative housing of the female connector has a pair of spaced side walls and a central island defined between the side walls; wherein the first contacting portion is received in the central island, and the second contacting portion is located outside the side wall and extends beyond the tip surface of the side wall.

* * * * *